United States Patent [19]

Merigan

[11] 4,262,684

[45] Apr. 21, 1981

[54] FOLDING PIPE STAND

[76] Inventor: Gary D. Merigan, 38250 Fairway, Clinton Township, Clinton County, Mich.

[21] Appl. No.: 88,050

[22] Filed: Oct. 24, 1979

[51] Int. Cl.[3] ..... A24F 9/14

[52] U.S. Cl. ..... 131/260; 211/60 M

[58] Field of Search ..... 131/260, 257; 211/60 M; 248/174; 206/244

[56] References Cited

U.S. PATENT DOCUMENTS

| | | | |
|---|---|---|---|
| 2,243,433 | 5/1941 | McIntyre | 131/260 UX |
| 3,678,940 | 7/1972 | Sobczak | 131/260 |
| 3,815,613 | 6/1974 | Reavis | 131/260 |

*Primary Examiner*—Stephen C. Pellegrino

*Attorney, Agent, or Firm*—Gifford, VanOphem, Sheridan and Sprinkle

[57] ABSTRACT

A stable and easily transportable folding pipe stand comprising a pair of support plates hinged together along one edge and a collapsible support member secured to and extending between facing surfaces of the support plates. Preferably the support member includes a centrally located aperture, the periphery of which engages the lower portion of the bowl of a smoking pipe.

7 Claims, 4 Drawing Figures

FOLDING PIPE STAND

BACKGROUND OF THE INVENTION

I. Field of the Invention

The present invention relates generally to stands for holding a smoking pipe and more particularly to such a stand which is easily folded into a substantially flat shape so that it can be easily carried in a clothing pocket.

II. Description of the Prior Art

Smoking pipes come in a variety of shapes and sizes. The shapes of the bowls and stems of the pipes are often designed for the sake of appearance or comfort and are not generally designed to be self-supporting. Some previously-known pipes are provided with a flat-bottomed bowl so that they can stand upright on a flat surface such as a table. Nevertheless, even these pipes can be toppled easily, especially when the pipes are designed for appearance or handling ease and the center of gravity is not positioned directly over the flat bottom so that the pipe is well balanced.

Many previously-known pipe holders or supports are disadvantageous in that they are designed to hold the plurality of pipes and are therefore bulky and not easily transportable. Other previously known pipe holders such as the stand disclosed in U.S. Pat. No. 1,894,080, designed to hold a single smoking pipe are designed for use only with straight stem pipes and are not adapted for use with curved stem pipes. Still others such as the pipe holder disclosed in U.S. Pat. No. 3,140,782 to Schulte, which can be used to hold a pipe having a curved stem as well as a pipe having a straight stem, are quite bulky and thus inconvenient for the pipe smoker to easily carry on his person.

SUMMARY OF THE PRESENT INVENTION

The present invention overcomes the above-mentioned disadvantages by providing a stand for holding a smoking pipe which stably supports the pipe on a flat surface such as a table and which is easily folded into a substantially flat shape. The simple construction of the stand of the present invention permits the stand to be appropriately sized to fit within a clothing pocket, and preferably, is small enough in its folded position to be carried like a business card such as in a wallet or suit-coat pocket.

This device generally comprises a pair of plates hinged together and having a collapsible support member secured therebetween. The hinge means permits the plates to swing apart and expose the support member extending between the plates. In their spaced apart position, the support plates can stably support the stand on a flat surface. A pipe can then be inserted in the pipe holder such that the bowl rests on the top surface of the support member while the stem of the pipe remains supported by the top edges of the plates adjacent to or above the hinge means. Preferably, the support member includes a bore or recess which engages the bottom of the bowl to stably support the bowl in an upright position.

When the pipe has been removed, the plates are easily pressed together, collapsing the support member therebetween so that the plates substantially flatly abut against each other. Thus the stand becomes relatively thin and is easily inserted in the pocket of the pipe smoker.

BRIEF DESCRIPTION OF THE DRAWING

The present invention will be better understood by reference to the following detailed description in conjunction with the accompany drawing wherein like references characters refer to like parts throughout the several views and in which.

DETAILED DESCRIPTION OF THE PRESENT INVENTION

Figure 1:
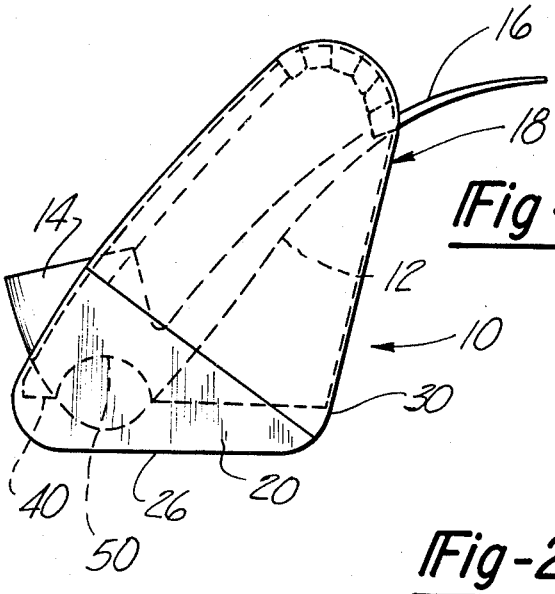
FIG. 1 is a side plan view of a pipe stand of the present invention.

Referring now to FIG. 1, the pipe stand 10 of the present invention is thereshown supporting a pipe 12 so that the open top of the bowl 14 of the pipe is held upright. The pipe stem 16 extends outwardly from the stand 10 and is supported by the intersection of the hinge means 18 and the side plates 20 and 22 in a manner to become readily apparent hereinafter.

Figure 2:
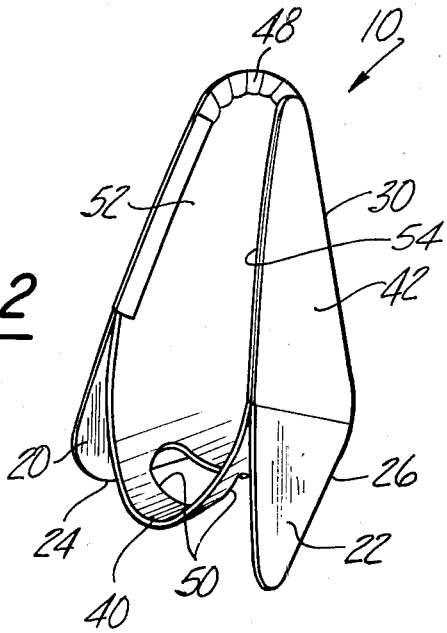
FIG. 2 is a perspective view of the pipe stand shown in FIG. 1, showing the stand in its open position.

As best shown in FIG. 2, the stand 10 comprises a pair of support plates 20 and 22. Each support plate 20 and 22 essentially comprises a surface support edge portion 24 and 26, respectively, and a hinge edge portion 28 and 30, respectively, meeting with respective surface edge portions at a corner of the plate. As shown in the illustration of the preferred embodiment shown in the drawings, the side plates are substantially triangular so that as best shown in FIG. 1, a portion of the bowl 14 extends outwardly from the plates when placed on the support member 40. Consequently, the pipe can be easily inserted and removed from the stand since the plates do not prevent the pipe smoker from easily grasping the pipe.

The corners of the plates are preferably rounded so that sharp points which could pierce or tear clothing are eliminated. As shown in the drawing, the corners between the surface support edge portions 24, 26 and the hinge edge portions 28, 30 of the plates 20 and 22 have a smaller radius than the remaining corners. This smaller radius is required when, as shown in the preferred embodiment, the hinge edge portions 28, 30 are inclined upwardly outwardly from the support surface edge portions 24, 26. Such a construction, though advantageous since it increases the distance between the points at which the pipe is supported and thus, the stability of the pipe within the stand, places the center of gravity closer to the rear end of the support surface edge portions. Therefore, the support surface edge portions must be extended so as to contact the supporting surface beneath the center of gravity. Therefore, although the stand 10 can be made so that the support surface edge portions 24, 26 extend to the end of the hinge edge portions 28, 30, thus forming a sharp corner, appropriate limitation of the inclination of the hinge edge portions 28, 30 with respect to the portions 24, 26 permits the corner to be at least partially rounded without sacrificing the stability of the pipe stand 10 upon the support surface or the stability of the pipe 12 within the stand 10. Preferably the side plates 20 and 22 are made of a gold plated metal but, of course, can be made of any other substantially rigid material.

Figure 3:
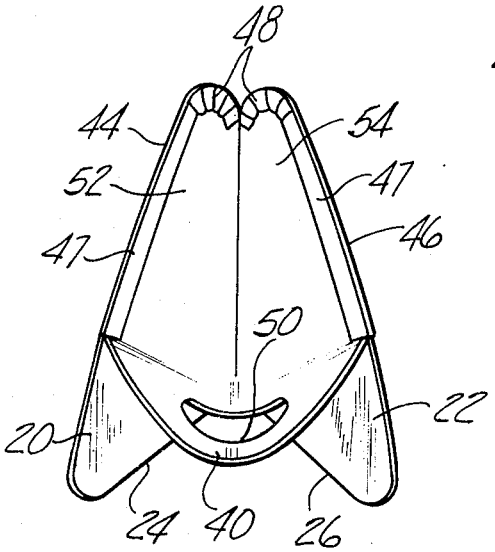
FIG. 3 is a front plan view of the pipe stand shown in FIGS. 1 and 2 in its open position.

In the preferred embodiment of the present invention as shown in the drawing, the hinge means 18 is made of a preformed sheet of leather 42. In the preferred embodiment, the single leather sheet 42 includes a pair of symmetrically shaped portions 44 and 46 which substantially coincide with a portion of the side plates 20 and 22, respectively. The edges of the sheet 42 are wrapped over the front edge and top corner of the support plates 20 and 22 as shown at 47 and 48 in FIGS. 2 and 3. At the center of the symmetrically shaped portions 44 and 46, the leather sheet 42 connects the plates 20 and 22 at their edge portions 28 and 30 along substantially the entire length of the edge portions 28 and 30. The leather sheet 42 is preferably secured to the side plates 20 and 22 by an age hardening adhesive although other fastening means are equally within the scope of the present invention.

The support member 40 of the preferred embodiment of the present invention is also made of a preformed sheet of leather having an enlarged central portion tapering toward narrow symmetrical end portions 52 and 54. The end portions are shaped to substantially coincide with a portion of the side plates 20 and 22, respectively. The symmetrical preshaped end portions 52 and 54 are secured to the facing surfaces of the side plates 20 and 22, respectively, near their upper portions. The central portion of the support member 40 depends downwardly and extends from the side plate 20 to the side plate 22 thus forming a bowl-shaped or arcuate, substantially horizontal support surface. The central portion of the support surface includes an aperture 50 so that when a pipe is rested on the support surface, a portion of the bowl extends through the aperture, whereby the periphery of the aperture 50 engages the bowl 14 and provides a stable support for the bowl. Preferably, for appearance sake as well as the prevention of delamination of the leather sheets at the edges of the support plates 20 and 22, the end portions 52 and 54 of the support member 40 are secured to the facing surfaces of the plates 20 and 22, respectively, before the end portions 47 and 48 of the hinge sheet 42 are folded into position.

Once the stand has been constructed as described above, the side plates 20 and 22 are spread apart about the hinged edge portions 28 and 30 so that the support edge portions 24 and 26 are angled with respect to each other at less than 180 degrees and stably support the connected plates 20 and 22 on a flat surface. When the plates are so positioned, the central portion of the support member 40 extends across from the side plate 20 to side plate 22 forming a substantially bowl shaped surface with the bowl engaging aperture 50 centrally aligned between the angled side plates 20 and 22. Thus, a pipe 12 can be easily inserted between the plates so that the bottom of the bowl 14 engages the periphery of the aperture 50 and the stem 16 rests against the top corners of the side plates 20 and 22 above the hinge means 18 against the folded portions 48 of the leather sheet 42. The use of the leather support member 40 and leather hinge means 42 provides a resting surface for the pipe bowl and pipe stem which will not mar the finished surfaces of the pipe. Nevertheless, the pipe stand of the present invention provides a stable support for the pipe since the support edge portions 24 and 26 stably support the stand 10 on a flat surface such as a table. Futhermore, the periphery of the aperture 50 in conjunction with the top corners of the plates 20 and 22, stably hold the pipe within the holder.

Figure 4:
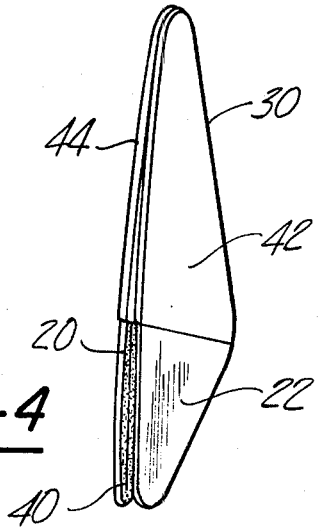
FIG. 4 is a perspective view similar to FIG. 2 but showing the pipe stand in its closed position.

When the pipe has been removed from the pipe stand, the side plates 20 and 22 are easily folded together, thus collapsing the flexible support member 40. Consequently, as shown in FIG. 4, the folded stand 10 is relatively thin and can thus be easily slipped into a clothing pocket or wallet compartment. The stand is, therefore, readily accessible for use when the pipe smoker again desires to support the pipe for cooling or storage.

Thus the present invention provides a stand for a smoking pipe which is compact, simple, readily accessible, and easily transportable from place to place, unlike previously-known pipe stands. In addition, the pipe stand is stably supported on a table or other flat surface. Moreover, the pipe is firmly and stably supported within the pipe stand. Consequently, the pipe stand of the present invention provides many advantages over the previously-known stands for holding smoking pipes.

Having thus described my invention, many modifications will become apparent to those skilled in the pertinent art without departing from the scope or spirit of the present invention as defined in the appended claims,

What is claimed is:

1. A folding stand for holding a smoking pipe comprising:

a pair of rigid support plates, each plate having a first surface engaging edge portion and a second edge portion angled with respect to said first edge portion;

hinge means for connecting said support plates together at said second edge portions, said plates being pivotal between a first position in which said first edges are substantially parallel to each other and said plates substantially flatly abut against each other, and a second position in which the planes of said support plates intersect at an angle less than 180°; and a collapsible support member secured to said support plates and extending between the facing surfaces of said support plates.

2. The invention as defined in claim 1 wherein said hinge means comprises a sheet of flexible material secured to the outer surfaces of said support plates.

3. The invention as defined in claim 2 wherein said flexible material is leather.

4. The invention as defined in claim 1 wherein said support member comprises a sheet of flexible material.

5. The invention as defined in claim 1 wherein said support member includes an aperture, and wherein with a pipe inserted in the pipe stand, the periphery of the aperture engages the bowl portion of a smoking pipe.

6. The invention as defined in claim 4 wherein said flexible material is leather.

7. The invention as defined in claim 1 wherein said support plates are made of gold plated metal.

* * * * *